US006121211A

United States Patent [19]

Stachew et al.

[11] Patent Number: 6,121,211

[45] Date of Patent: Sep. 19, 2000

[54] ENGINE OIL HAVING DITHIOCARBAMATE AND ALDEHYDE/EPOXIDE FOR IMPROVED SEAL PERFORMANCE, SLUDGE AND DEPOSIT PERFORMANCE

[75] Inventors: Carl F. Stachew, Wickliffe; William D. Abraham, South Euclid; James A. Supp, Parma; James R. Shanklin, Concord; Gordon David Lamb, Shaker Heights, all of Ohio

[73] Assignee: The Lubrizol Corporation, Wickliffe, Ohio

[21] Appl. No.: 09/118,280

[22] Filed: Jul. 17, 1998

[51] Int. Cl.[7] ..... C10M 135/18

[52] U.S. Cl. ..... 508/304; 508/364; 508/513; 508/577

[58] Field of Search ..... 508/364, 513, 508/577, 304

[56] References Cited

U.S. PATENT DOCUMENTS

| | | | |
|---|---|---|---|
| 3,127,353 | 3/1964 | Roos | 508/364 |
| 3,658,637 | 4/1972 | Danielson | 161/231 |
| 3,876,550 | 4/1975 | Holubec | 508/443 |
| 4,076,642 | 2/1978 | Herber et al. | 252/78.5 |
| 4,612,129 | 9/1986 | DiBiase et al. | 508/443 |
| 4,661,120 | 4/1987 | Carr et al. | 44/57 |
| 4,758,362 | 7/1988 | Butke | 508/364 |
| 5,759,965 | 6/1998 | Sumiejski | 508/433 |

FOREIGN PATENT DOCUMENTS

| | | | |
|---|---|---|---|
| 612 835 | 8/1994 | European Pat. Off. | 129/18 |

*Primary Examiner*—Margaret Medley
*Assistant Examiner*—Cephia D. Toomer
*Attorney, Agent, or Firm*—David M. Shold

[57] ABSTRACT

Disclosed is a lubricating composition having a major amount of an oil of lubrication viscosity and a minor amount of (A) at least one thiocarbamate wherein the improvement comprises adding to said thiocarbamate (B) a sludge preventing and seal protecting amount of at least one aldehyde or epoxide or mixtures thereof.

22 Claims, No Drawings

ENGINE OIL HAVING DITHIOCARBAMATE AND ALDEHYDE/EPOXIDE FOR IMPROVED SEAL PERFORMANCE, SLUDGE AND DEPOSIT PERFORMANCE

FIELD OF THE INVENTION

Internal combustion engines operate under a wide range of temperatures including low-temperature, stop-and-go service as well as high-temperature conditions produced by continuous high-speed driving. Stop-and-go driving, particularly during cold, damp weather conditions, leads to formation of a sludge in the crankcase and in the oil passages of a gasoline or a diesel engine. This sludge seriously limits the ability of the crankcase oil to lubricate the engine effectively. In addition, the sludge with its entrapped water tends to contribute to rust formation in the engine. These problems tend to be aggravated by the manufacturer's lubrication service recommendations which specify extended drain oils.

Another problem facing the lubricant manufacturer is that of seal deterioration in the engine. All internal combustion engines use elastomer seals, such as viton seals, in their assembly. Over time, these seals are susceptible to serious deterioration caused by the lubricating oil composition and the deterioration results in oil leaking from the engine. A lubricating oil composition that degrades the elastomer seals in an engine is unacceptable to engine manufacturers and has limited value.

BACKGROUND OF THE INVENTION

It is known to employ dithiocarbamates in the formulations of crankcase lubricating oil compositions. These dithiocarbamates are the reaction product of secondary amines and carbon disulfide which form the dithiocarbamic acid. The dithiocarbamic acid is immediately consumed upon formation with other reagents present to give the dithiocarbamates.

U.S. Pat. No. 3,876,550 (Holubec, Apr. 8, 1975) relates to a lubricating composition that comprises a major proportion of a lubricating oil and a minor proportion, sufficient to improve the anti-oxidant and rust-inhibiting properties, of the composition of an additive combination. This additive combination comprises one or more anti-oxidants based upon alkylene dithiocarbamates and one or more rust inhibitors based upon hydrocarbon-substituted succinic acids or certain derivatives thereof.

U.S. Pat. No. 4,612,129 (Di Biase et al., Sep. 16, 1986) relates to sulfur-containing compositions which are oil-soluble and which are useful as lubricating oil additives particularly in lubricants containing little or no phosphorus. More particularly, this reference relates to lubricants containing little or no phosphorus and a composition comprising at least one metal dithiocarbamate, at lease one sulfurized organic compound and at least no auxiliary corrosion inhibitor.

U.S. Pat. No. 4,758,362 (Butke, Jul. 19, 1988) relates to various carbamate additives for lubricating compositions. More specifically, this reference relates to carbamate additives derived from the reaction of an amine with carbon disulfide and a reactant containing an activated, ethylenically unsaturated bond or an alpha-chloro or alpha-bromo carboxylic acid or derivative thereof. These additives impart improved extreme-pressure and anti-wear properties to lubricating compositions, particularly lubricating compositions which are phosphorus-free or contain a very low phosphorus concentration.

SUMMARY OF THE INVENTION

Disclosed is a composition for reducing sludge and degradation of elastomer seals having a major amount of an oil of lubricating viscosity and a minor amount of (A) at least one thiocarbamate of the structure

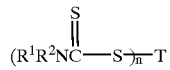

(I)

wherein $R^1$ and $R^2$ are independently alkyl of 1 to about 7 carbon atoms, aryl, aralkyl or together form an alicyclic or heteroalicyclic ring in which the ring is completed through the nitrogen, n is 1 or 2 and when n is 1, T is monovalent metal or $$—CR^3R^4(CR^{12}R^{13})_aQ$$

wherein a is 0 or 1, $R^3$, $R^4$, $R^{12}$ and $R^{13}$ are independently hydrogen, alkyl or aryl and Q is

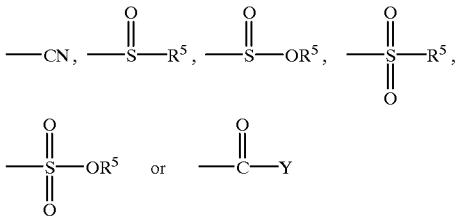

wherein $R^5$ is hydrogen, alkyl, or aralkyl, Y is hydrogen —OH, $R^6$, —$OR^6$, —$OR^7$—OH, or —$NR^8R^9$ where $R^6$ is alkyl, aryl or aralkyl, $R^7$ is alkylene of 1 to about 7 carbon atoms and $R^8$ and $R^9$ are independently hydrogen, alkyl, cycloaliphatic, heteroalicyclic or together form an alicyclic or heteroalicyclic radical in which the ring is completed through the nitrogen with the proviso that when a is 0, Y is —$OR^6$; when n is 2, T is a divalent metal or hydrocarbylene wherein the improvement comprises adding to said thiocarbamate (B) a sludge preventing and seal protecting amount of at least one aldehyde or epoxide or mixtures thereof.

DETAILED DESCRIPTION OF THE INVENTION (A) The Thiocarbamate

Thiocarbamates having utility in this invention are of the structure

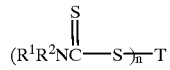

(I)

wherein $R^1$ and $R^2$ are independently alkyl of 1 to about 7 carbon atoms, aryl, aralkyl or together form an alicyclic or heteroalicyclic ring in which the ring is completed through the nitrogen, n is 1 or 2 and when n is 1, T is monovalent metal or —$CR^3R^4(CR^{12}R^{13})_aQ$ wherein a is 0 or 1, $R^3$, $R^4$, $R^{12}$ and $R^{13}$ are independently hydrogen, alkyl or aryl and Q is

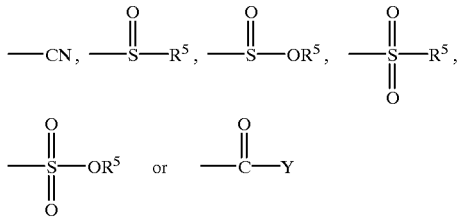

wherein $R^5$ is hydrogen, alkyl, or aralkyl, Y is hydrogen —OH, $R^6$, —OR, —$OR^7$—OH, or —$NR^8R^9$ where $R^6$ is alkyl, aryl or aralkyl, $R^7$ is alkylene of 1 to about 7 carbon atoms and $R^8$ and $R^9$ are independently hydrogen, alkyl, cycloaliphatic, heteroalicyclic or together form an alicyclic or heteroalicyclic radical in which the ring is completed through the nitrogen with the proviso that when a is 0, Y is —$OR^6$; and when n is 2, T is a divalent metal or a hydrocarbylene group.

As can be observed from the above structure, there are two classes of thiocarbamates differentiated only by the value of n. When n is 1, then one thiocarbamate group is present and when n is 2, two thiocarbamate groups are present. The T of the general structure is entirely different for n=1 and n=2.

When n is 1, T is a monovalent metal and $R^1$ and $R^2$ are each independently hydrocarbyl groups in which the total number of carbon atoms in $R^1$ and $R^2$ are sufficient to render the metal salt oil-soluble. The hydrocarbyl groups $R^1$ and $R^2$ may be alkyl groups cycloalkyl groups, aryl groups, alkaryl groups or aralkyl groups. $R^1$ and $R^2$, taken together, may represent the group consisting of polymethylene groups, thereby forming a cyclic compound with the nitrogen. Generally, the alkyl group will contain at least two carbon atoms. Monovalent metals that can be employed are the alkali metals of lithium, sodium and potassium.

In preparing the dithiocarbamates of this invention, dihydrocarbyl amines are reacted with carbon disulfide to form the dithiocarbamic acid. This acid is not isolated and is consumed as soon as it is generated into component (A).

In selecting a metal salt of a dithiocarbamic acid to be used as (A) of this invention, $R^1$ and $R^2$ and the metal may be varied so long as the metal salt is adequately oil-soluble. Preferably $R^1$ and $R^2$ each contain 3 to 5 carbon atoms. The nature and type of the mineral base stock, and the type of service contemplated for the treated lubricating oil are important modifying influences in the choice of the metal.

Mixtures of metal salts of dithiocarbamic acids also are contemplated as being useful in the present invention. Such mixtures can be prepared by first preparing mixtures of dithiocarbamic acids and thereafter converting said acid mixtures to metal salts, or alternatively, metal salts of various dithiocarbamic acids can be prepared and thereafter mixed to give the desired product. Thus, the mixtures which can be incorporated in the compositions of the invention may be merely the physical mixture of different metallic dithiocarbamic compounds or different dithiocarbamate groupings attached to the same polyvalent metal atom.

Examples of alkyl groups are ethyl, propyl, butyl, amyl, hexyl, heptyl, octyl, decyl, dodecyl, tridecyl, pentadecyl, and hexadecyl groups including the isomeric forms thereof. Examples of cycloalkyl groups include cyclohexyl and cycloheptyl groups, and examples of aralkyl groups include benzyl and phenylethyl. Examples of polymethylene groups include penta- and hexamethylene groups, and examples of alkyl-substituted polymethylene groups include methyl pentamethylene, dimethyl pentamethylene, etc.

When T is not the monovalent metal, it is $$—CR^3R^4(CR^{12}R^{13})_aQ$$

wherein a is 0 or 1, $R^3$, $R^4$, $R^{12}$ and $R^{13}$ are independently hydrogen, alkyl or aryl and Q is

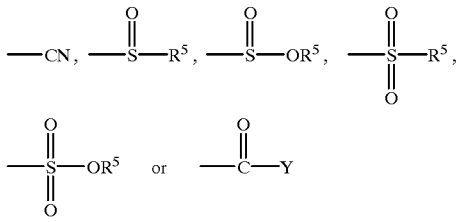

wherein $R^5$ is hydrogen, alkyl, or aralkyl, Y is hydrogen —OH, $R^6$, —$OR^6$, —$OR^7$—OH, or —$NR^8R^9$ where $R^6$ is alkyl, aryl or aralkyl, $R^7$ is alkylene of 1 to about 7 carbon atoms and $R^8$ and $R^9$ are independently hydrogen, alkyl, cycloaliphatic, heteroalicyclic or together form an alicyclic or heteroalicyclic radical in which the ring is completed through the nitrogen with the proviso that when a is 0, Y is —$OR^6$. Preferably $R^6$ is an alkyl group containing from 1 to 4 carbon atoms.

A preferred group of compounds for when T is not the monovalent metal is defined by the above formula where $R^3$, $R^4$, $R^{12}$ and $R^{13}$ are hydrogen, a is 1 and Q is

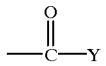

wherein Y is —OH, $R^6$, —$OR^6$, —$OR^7$—OH where $R^7$ is alkylene of 1 to about 7 carbon atoms or —$NR^8R^9$.

A most preferred group of compounds is defined by the above formula where a is 0, $R^3$ and $R^4$ are hydrogen or methyl, and Y is OH, $OR^6$ wherein $R^6$ is methyl or ethyl, $OR^7$—OH, where $R^7$ is alkylene of 1 to about 4 carbon atoms and $NR^8R^9$ wherein $R^8$ and $R^9$ are hydrogen.

One advantage of using the above-described carbamate compounds is that they may be prepared in a high-yield, single-step reaction. These compounds are derived from an amine, carbon disulfide or carbonylsulfide or source materials for these reactants and a reactant containing an activated, ethylenically-unsaturated bond or an alpha-chloro or alpha-bromo carboxylic acid or derivative thereof. These reactants are charged to a reactor and stirred without heating since the reaction is exothermic. Once the reaction reaches the temperature of the exotherm, the reaction mixture is held at a temperature within a range of the temperature of the exotherm to insure a complete reaction, followed by the removal of volatiles under reduced pressure. Following this procedure, the mixture is filtered and the final product is obtained in high yield.

With respect to the different reactants that may be utilized to prepare the compounds of the present invention, it has previously been pointed out that carbon disulfide ($CS_2$), carbonylsulfide (COS) or source materials for these reactants may be employed.

With respect to the amine reactants, secondary amines containing alkyl groups of 1 to about 7 carbon atoms, an aryl group, aralkyl group or a heteroalicyclic group where the nitrogen of the amine makes up the ring may be used. Specific amines which have been found to be useful within the scope of the present invention include dimethylamine, diethylamine, dipropylamine, dibutylamine, diamylamine, dihexylamine and diheptylamine. Also, there may be mentioned diphenylamine, dibenzylamine and the like. Furthermore, the non-symmetric amines such as N-methyl-N-ethylamine, N-ethyl-N-butylamine, N-ethyl-N-pentylamine and the like may be found to be useful within the scope of the present invention. Likewise, N-pentylaniline and the like may be used.

Among the suitable heterocyclics are aziridines, azetidines, azolidines, pyrolidine, pyridine, di-, and tetrahydropyridines, pyrroles, indoles, quinoline, morpholine, picolines, piperidine and the like. Mixtures of two or more of these heterocyclic amines can be used. Typical heterocyclic amines are the saturated 5- and 6-membered heterocyclic amines.

With respect to the reactants containing an activated, ethylenically unsaturated bond or an alpha-chloro or alpha-bromo acid, these reactants may be illustrated by the following formula:

$$(CR^{10}R^{11}(CR^{20})_x(R^{21})_b)Z \quad \text{(II)}$$

wherein $R^{10}$ and $R^{11}$ are independently H, alkyl, aryl, Cl or Br; $R^{20}$ is H, alkyl, aryl or aralkyl; x is 0 or 1, b is 0 or 1 where x+b is 1; $R^{21}$ is H, alkyl or aryl, chloro or bromo and Z is

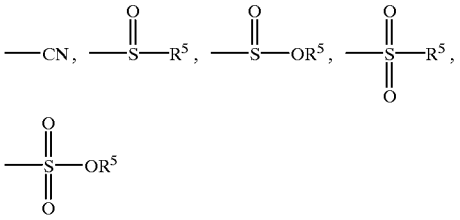

wherein $R^5$ is H, alkyl or aralkyl, and

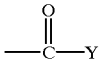

wherein Y is H, OH, $R^6$ where $R^6$ is alkyl, aryl or aralkyl, $OR^6$, $OR^7$—OH where $R^7$ is alkylene of 1 to about 7 carbon atoms and $NR^8R^9$ where $R^8$ and $R^9$ are independently H, alkyl, cycloaliphatic, heteroalicyclic or together form an alicyclic or heteroalicyclic radical in which the ring is completed through the nitrogen; with the proviso that when x is 0, Y is not $OR^6$.

As specific species encompassed by the above Formula (II), there may be mentioned methylacrylate, ethylacrylate, 2-ethylhexylacrylate, 2-hydroxyethylacrylate, ethylmethacrylate, 2-hydroxyethylmethacrylate, 2-hydroxypropylmethacrylate, 2-hydroxypropylacrylate, acrylamide, acrylonitrile, ethylsulfonylethene, methylsulfinylethene, and the like. Also, alpha-chloroacetic acid and alpha-bromoacetic acid and derivatives thereof may be used to prepare the compounds of the present invention.

The relative amounts of the reactants, discussed above, used to prepare the carbamate compounds of the present invention is not particularly critical. The charge ratios to the reactor can vary over a wide range where economics and the amount of the product desired are controlling factors. Thus, the charge ratio of the amine to the $CS_2$ or COS reactant to the ethylenically unsaturated reactant may vary 5:1:1 to 1:5:1 to 1:1:5. As a most preferred embodiment, the charge ratios of these reactants will be 1:1:1.

The preparation of specific compounds of the present invention are further illustrated in the examples that follow. While these examples are presented to show one skilled in the art how to operate within the scope of this invention, they are not to serve as a limitation on the scope of the invention where such scope is defined in the claims. It is pointed out that in the following examples, and elsewhere in the present specification and claims, all percentages, as well as all parts, are intended to express percent by weight and parts by weight unless otherwise specified.

EXAMPLE A-1

A 1-liter, 4-necked flask was fitted with a mechanical stirrer, thermometer, addition funnel and a water cooled reflux condenser. It was charged with 116 g 2-hydroxyethylacrylate and 76 g $CS_2$. Dibutylamine (129 g) was added over 3.1 hours with an exotherm to 47° C. The mixture was stirred for 2 hours. Heating was continued at 45°–55° C. and held at this temperature for 2.5 hours. The mixture was cooled. The mixture was vacuum stripped at 68° C. at 9 mm Mercury. No distillate was collected. The reaction mixture was filtered through diatomaceous earth. The yield was 303 g of a clear, yellow liquid.

EXAMPLE A-2

A 1-liter flask was fitted with a mechanical stirrer, thermometer, addition funnel and a water-cooled, reflux condenser. The flask was charged with 71 g of acrylamide and 60 g of 95% ethanol. This mixture was stirred at room temperature for ¾ hour. An additional 40 g of 95% ethanol was added to completely dissolve the acrylamide. To the solution was added 76 g of $CS_2$. Diamylamine (157 g) was added over 1.23 hours. An exotherm to 41° C. occurred. This mixture was heated and held at 50°–55° C. for 3 hours. The mixture was subsequently vacuum stripped at 91° C. and 20 mm Mercury to yield 113 g of distillate. The residue was filtered through diatomaceous earth filter aid with a filtrate yield of 281 g of clear, yellow, viscous liquid. This represented a 92.4% yield based on a theoretical yield of 304 g.

EXAMPLE A-3

A 1-liter flask was fitted with a mechanical stirrer, thermometer, an addition funnel and a dry ice/isopropanol condenser. The flask was charged with 157 g of diamylamine. $CS_2$ (76 g) was added while stirring the mixture. This addition produced an exotherm to approximately 55° C. in approximately 50 minutes. To the flask were added 50 g of toluene after which 56 g of acrolein were added at 25° C. over ¾ hour. This addition produced an exotherm to 45° C. The mixture was stirred and allowed to cool to room temperature for 6 hours. This mixture was then stirred for another 4½ hours at 50° C. and allowed to stand overnight. The mixture was then vacuum stripped at 85° C. and 8 mm Mercury to give 64 g of distillate. The residue was filtered through diatomaceous earth filter aid to give 240 g of filtrate, which was a clear, viscous red liquid. This represented an 83% yield based on 289 g theoretical.

EXAMPLE A-4

A 1-liter flask was fitted with a mechanical stirrer, thermometer, addition funnel and a water-cooled, reflux condenser. The flask was charged with 172 g of methylacrylate and 156 g $CS_2$. This mixture was stirred at room temperature and 146 g of diethylamine were added over 2¾ hours, producing an exotherm to 65° C. The mixture was then held at 55° C. for 2½ hours and then allowed to cool while standing overnight. The reaction mixture was then stirred and heated to approximately 55° C. and held at that temperature for 2 hours. The mixture was then vacuum stripped at 73° C. at 9 mm Mercury. The residue was then filtered through diatomaceous earth filter aid to give 447 g of a clear, brown filtrate. This represented a 95.1% yield based on a theoretical yield of 470 g.

EXAMPLE A-5

A 1-liter flask was fitted with a mechanical stirrer, thermometer, addition funnel and a water-cooled, reflux condenser. The flask was charged with 86 grams of methylacrylate and 76 g $CS_2$. This mixture was stirred at room temperature and 129 g of dibutylamine were added. This addition took place over 2.17 hours and produced an exotherm to 53° C. The mixture was then heated and held at 55° C. for 4 hours. The mixture was then vacuum stripped to 76° C. at 8 mm Mercury. The residue was then filtered through diatomaceous earth filter aid to give 274 g of a clear, yellow filtrate.

EXAMPLE A-6

A 1-liter flask was fitted with a mechanical stirrer, thermometer, addition funnel and a water-cooled, reflux condenser. The flask was charged with 116 grams of 2-hydroxyethylacrylate and 76 grams $CS_2$. This mixture was stirred at room temperature and 157 g of diamylamine were added over 1.3 hours. This addition produced an exotherm to 68° C. The mixture was allowed to cool for 0.75 hour and stand overnight. The mixture was then heated and stirred to approximately 60°–65° C. for 2 hours. The mixture was then vacuum stripped at 98° C. at 10 mm Mercury. A trace of distillate was collected. The residue was then filtered through 10 g of diatomaceous earth to give 332 g of a clear, yellow filtrate.

When n is 2, T is a divalent metal or a hydrocarbylene group. Suitable divalent metals include, for example, the alkaline earth metals, cadmium, magnesium, tin, molybdenum, iron, copper, nickel, cobalt chromium and lead. As a hydrocarbylene group, T contains from 1 to 4 carbon atoms and preferably is methylene.

The criteria for when n is 2 and T is a divalent metal also applies for when n is 1 and T is a monovalent metal. One of the criterion relates to the selection of the metal, and the size of the $R^1$ and $R^2$ groups such that the metal dithiocarbamate is oil soluble. Another criterion is that mixtures of metal salts of dithiocarbamic acids are contemplated as being useful. Further, the mixtures whose n is 2 and T is a divalent metal can be prepared in the same manner as where n is 1 and T is a monovalent metal.

Specific examples of divalent metal dithiocarbamates useful as component (A) in the compositions of this invention include cadmium dibutyldithiocarbamate, cadmium dioctyldithiocarbamate, cadmium octylbutyl-dithiocarbamate, magnesium dibutyldithiocarbamate, magnesium dioctyldithio-carbamate, cadmium dicetyldithiocarbamate, sodium diamyldithiocarbamate, and sodium diispropyldithiocarbamate.

The various metal salts of dithiocarbamic acids utilized as component (A) are well known in the art and can be prepared by known techniques.

When n is 2 and T is an alkylene radical, T may be either a straight-chain alkylene, a branched-chain alkylene, or an aromatically substituted alkylene. In general, the range of carbon atoms in this alkylene group is from 1 to about 8. The preferred alkylene radical is methylene (—$CH_2$—).

The alkylene dithiocarbamates are known in the art and several methods for their preparation are also known. The antioxidant activity in motor oil of various alkylene dithiocarbamates has been reported by Denton and Thompson, Inst. Petrol. Rev. 20 (230) 46–54 (1966).

U.S. Pat. No. 2,384,577 issued to Thomas discloses a suitable general method for the preparation of the subject alkylene dithiocarbamates. This method involves the reaction of a salt of a dithiocarbamic acid with a suitable dihaloacyclic hydrocarbon in the presence of a suitable reaction medium. Suitable reaction media include alcohols, such as ethanol and methanol; ketones, such as acetone and methyl ethyl ketone; ethers, such as dibutyl ether and dioxane; and hydrocarbons, such as petroleum ether, benzene and toluene. This reaction is generally carried out at a temperature within the range of from about 25° to 150° C. depending upon the boiling point of the solvent used as the reaction medium. Nakai, Shioya, and Okaware, Makromol, Chem. 108 95–103 (1967) have reported the preparation of various ethylene dithiocarbamates by the reaction of an ethanolic solution of ethylenedichloride with an ethanolic solution of the appropriate sodium N,N-di-substituted dithiocarbamates.

U.S. Pat. Nos. 1,726,647 and 1,736,429 issued to Cadwell describe the preparation of phenylmethylene bis (dialkyldithiocarbamates), such as phenylmethylene bis (dimethyldithiocarbamate). The preparative procedure of Cadwell's patents is similar to that disclosed by Thomas and involves the reaction of a salt of a dialkyldithiocarbamate with benzal chloride to prepare the subject phenylmethylene bis(dialkyldithiocarbamates). Cadwell also discloses the preparation of the intermediate salt of a dialkyldithiocarbamate by the reaction of a dialkylamine, carbon disulfide, and an inorganic base.

A rather elegant process for the preparation of ethylene dithiocarbamates has been reported by Pilgram, Phillips and Korte, J. Org. Chem. 29 1848–50 (1964). This process involves the reaction of cyclic phosphoramidites derived from ethylene glycol with tetraalkylthiuram disulfides to form the corresponding ethylene bis (dialkyldithiocarbamates). The preparation of ethylene bis (dipropyldithiocarbamates) from tetrapropylthiuram disulfide and 2-piperidino-1,3,2-dioxaphospholane is exemplary of the Pilgram et al. process.

Unsymmetrical alkylene dithiocarbamates, such as ethylene (tetramethylene dithiocarbamate) (dibutyl dithiocarbamate) are conveniently prepared by suitable modification of the above procedures. Thus, one such modification involves the reaction of a mixture of amines with carbon disulfide and the inorganic base to prepare the intermediate salts, i.e., the substituted dithiocarbamates. The substituted dithiocarbamates derived from the mixed amines is then reacted with the appropriate dihaloalkane. Another modification involves the reaction of an excess of the dihaloalkane with one substituted dithiocarbamate, isolating the resulting monoesterhalide, and reacting this monoesterhalide with the other substituted dithiocarbamate.

(B) The Sludge Preventer and Seal Protector

In order to complete the composition of this invention, a sludge preventing and seal protecting amount of at least one aldehyde or epoxide or mixtures thereof is employed.

It is known that as dithiocarbamates decay or degrade, amines are formed. This formation of a free amine causes a deleterious effect either by reacting with other components that are present such that sludge is formed, or by reacting with (attacking) the viton seals to degrade these seals. While not wishing to be bound by theory, the sludge preventer and seal protector are believed to react with the amines to render the amines innocuous. It is believed that aldehydes react with amines according to the following two equations.

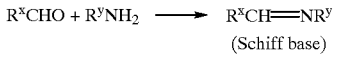

The resulting Schiff base probably reacts with another mole of amine to form the following product:

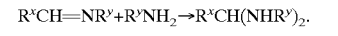

It is believed that epoxides react with amines according to the following two equations.

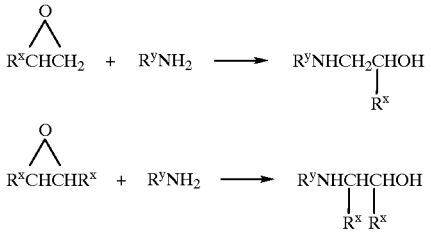

The Aldehyde

The aldehyde as a sludge preventer/seal protector is an aromatic aldehyde. As aromatic aldehydes, the aldehyde contains a substituted phenyl group. The substitutent groups may be hydroxy, alkyl, alkoxy, and also combinations of hydroxy and alkyl or hydroxy and alkoxy. Preferred aromatic aldehydes are

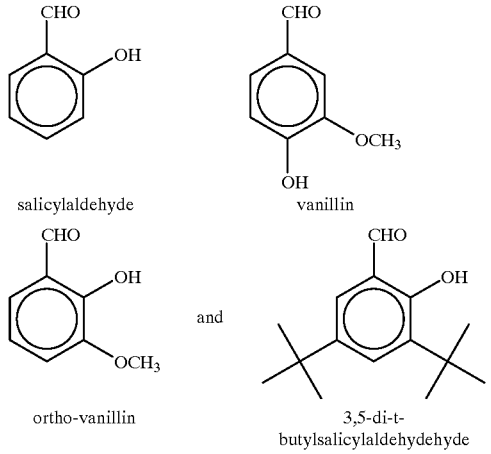

Especially preferred aromatic aldehydes are 3,5-di-t-butylsalicylaldehyde and ortho-vanillin.

The Epoxides

The epoxides having utility in this invention contain at least one oxirane ring. The oxirane ring may be a terminal oxirane ring or an internal oxirane ring. In order for an oxirane ring to be a terminal oxirane ring, one of the carbon atoms to which the oxirane oxygen is attached must contain two hydrogen atoms. In order for an oxirane ring to be an internal oxirane ring, neither of the carbon atoms to which the oxirane oxygen is attached can contain more than one hydrogen atom.

A terminal oxirane ring is of the structure

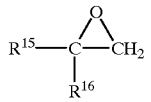

wherein $R^{15}$ is a hydrocarbyl group containing from 1 to 100 carbon atoms and $R^{16}$ is hydrogen or an alkyl group containing from 1 to 4 carbon atoms. In a preferred embodiment, $R^{15}$ is an alkyl group containing from 1 to 40 carbon atoms and $R^{16}$ is hydrogen. In a most preferred embodiment, $R^{15}$ contains 14 carbon atoms and $R^{16}$ is hydrogen. This epoxide is hexadecylene oxide. In another preferred epoxide, $R^{15}$ is an alkyl group containing from 8 to 50 carbon atoms and $R^{16}$ is a methyl group. As a hydrocarbyl group, $R^{15}$ may contain a heteroatom as in $R^{18}OCH_2$— wherein $R^{18}$ is an alkyl group containing from 1 to 18 carbon atoms. In yet another preferred epoxide, $R^{15}$ is

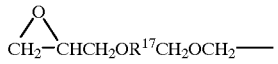

wherein $R^{17}$ contains from 1 to 12 carbon atoms. With this epoxide, two oxirane rings are present as well as an ether linkage. This is an example of diglycidyl ether. Diglycidyl ethers of this type can be obtained from Shell Chemical as, for example, Heloxy® Modifier 67, a diglycidyl ether of 1,4 butanediol and Heloxy® Modifier 68, a diglycidyl ether of neopentyl glycol.

Limonene dioxide functions both as a terminal epoxide and an internal epoxide.

Epoxides having utility in this invention can also contain at least one internal oxirane ring. Useful internal oxiranes are of the formula

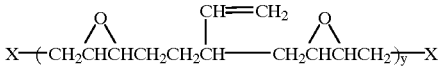

wherein X is independently —H or —OH and y is an integer of from 2 to 6. This epoxide is available from Elf Atochem as a hydroxy or hydrogen terminated 3% or 6% oxirane content, respectively, as an epoxidized polybutadiene. Another internal oxirane is of the structure

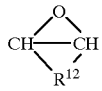

wherein $R^{12}$ is an alkylene group containing 3 or 4 carbon atoms.

Other internal epoxides are

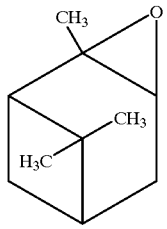

alpha pinene oxide and

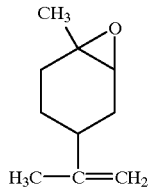

limonene monoxide

As noted above, limonene dioxide is also an internal epoxide.

The epoxide can also be a vegetable oil epoxide or an ester of a vegetable oil epoxide. Both of these epoxide types are available from Elf Atochem in the Vikoflex® series. Vikoflex® 7170 and Vikoflex® 7190 are epoxidized soybean oil and epoxidized linseed oil, respectively. As an ester of a vegetable oil epoxide, the ester group contains from 1 to 8 carbon atoms. Representative examples of esters of vegetable oil epoxides are Vikoflex® 7010, a methyl ester of epoxidized soybean oil, Vikoflex® 9010, a methyl ester of epoxidized linseed oil, Vikoflex® 7040 and Vikoflex® 9040, butyl esters of epoxidized soybean oil and epoxidized linseed oil, respectively and Vikoflex® 7080 and Vikoflex® 9080, 2-ethylhexyl esters of epoxidized soybean oil and epoxidized linseed oil, respectively.

The composition of this invention comprises an admixture of components (A) and (B). For every 10 parts of (A) that are employed, there are generally 2–50 parts of (B) present, preferably from 3–40 parts of (B) and most preferably from 4–30 parts of (B). Order of addition is of no consequence. Component (A) can be added to Component (B) or Component (B) can be added to Component (A). Additionally, other components can be present within either (A) or (B) when the admixture is carried out. Further component (B) can be added to component (A) as a top-treatment to a final crankcase blend or added to a concentrate during typical blending conditions.

To establish the efficacy of this invention, the inventive composition of components (A) and (B) along with other components are blended together to give an inventive test formulation. This inventive test formulation is measured against a baseline formulation. The baseline formulation contains all the components of the test formulation but for component (B). Both the inventive test formulation and the baseline formulation are considered to be fully formulated crankcase oils. These formulations are evaluated in a sludge screen test to determine the ability not to produce sludge. Screen tests are used in lieu of conducting a full engine test evaluation. Reliable screen tests are a valid predictor of engine performance.

To a test tube containing a formulation is added a fuel and an inorganic acid. The contents are mixed at room temperature for about one minute. The test tube containing the contents is then placed in a heated bath. Air and $NO_x$ are bubbled into the contents. After several hours, a catalyst is added to the contents.

A drop of the test blend is spotted onto chromatographic paper which is then stored in a heated oven and then removed from the oven for the remainder of the test evaluation. The original spot continues to spread over time becoming larger in diameter. In many instances, an inner spot begins to form. A ratio of the diameter of the small spot:diameter of the large spot is determined at specific test hours. The ratio is expresed as a percent. A high ratio (greater than 50 percent) represents a formulation with low sludge and a low ratio (less than 50 percent) represents a formulation with high sludge. The test is stopped and evaluated under two conditions:

1. When the ratio is at 50 percent, the total hours to achieve 50 percent becomes the test value, or 2. When the ratio is above 50 percent for the duration of the test, which is 122 hours, the test value then is 122 hours.

In the examples of the following table, Example 1 is to be compared to Baseline A, the baseline for Example 1. Examples 2 and 3 are to be compared to Baseline B, the baseline for Examples 2 and 3.

Sludge Test

| Example | Oil | (A) | (B) | Hours to Fail |
|---|---|---|---|---|
| A | 112 parts | 0.5 parts product of Example A-5 | None | <67 |
| 1 | 112 parts | 0.5 parts product of Example A-5 | 0.25 parts o-vanillin | 67 |
| B | 103 parts | 0.5 parts product of Example A-5 | None | <67 |
| 2 | 103 parts | 0.5 parts product of Example A-5 | 0.25 parts o-vanillin | 121 |
| 3 | 103 parts | 0.5 parts product of Example A-5 | 1.0 part hexadecylene oxide | 120 |

A higher test value hours indicates a more desirable performance.

The inventive composition of this invention is also evaluated in the Volkswagon PV 3344 Viton Seal Compatibility Test. This test is designed to test the compatibility of a crankcase lubricating oil that contains a nitrogen-containing dispersant. The elastomer to be tested is the Parker-Pradifa SRE AK6, which also has the designation FKM E-281. Prior to the test the elastomer specimens are thermally conditioned at 150° C. for a period of 48 hours. The purpose of this conditioning is to drive off moisture which is readily absorbed by the filler component of this elastomer.

As described in the sludge test above, the inventive composition of components (A) and (B) along with other components are blended together to give an inventive test formulation. Thermally conditioned specimens are immersed into the test formulation wherein the volume of the formulation: volume of the elastomer is approximately 85.1. The immersion test temperature is 150° C. and the immersion period is a total of 282 hours made up of three 94-hour periods. After the first two 94-hour periods, the test formulation is replaced with a fresh test formulation. At the completion of the 282-hour period, the elastomer specimens are evaluated for tensile strength, elongation and cracking. In order to pass this test, the tensile strength must be at least 8 Newtons per square millimeter; the rupture elongation must be at least 160 percent, and there can be no evidence of cracking.

In the examples of the following table, Examples 4 and 5 are to be compared to Example C, the baseline for Examples 4 and 5.

Viton Seal Compatibility Test

| Example | Oil | (A) | (B) | Tensile Strength | Elongation | Cracking |
|---|---|---|---|---|---|---|
| C | 95 Parts | 0.5 Parts Product of Example A-5 | None | 5.6 | 128 | Yes |
| 4 | 95 Parts | 0.5 Parts Product of Example A-5 | 0.25 Parts o-vanillin | 10.4 | 222 | No |
| 5 | 95 Parts | 0.5 Parts Product of Example A-5 | 1.0 Part hexadecylene oxide | 8.1 | 173 | No |

While the invention has been explained in relation to its preferred embodiments, it is to be understood that various modifications thereof will become apparent to those skilled in the art upon reading the disclosure. Therefore, it is to be understood that the invention disclosed herein is intended to cover such modifications as fall within the scope of the appended claims.

What is claimed is:

1. A composition for reducing sludge and degradation of elastomer seals having a major amount of an oil of lubricating viscosity and a minor amount of (A) at least one thiocarbamate of the structure

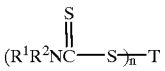

(I)

wherein $R^1$ and $R^2$ are independently alkyl, aryl, aralkyl or together form an alicyclic or heteroalicyclic ring in which the ring is completed through the nitrogen, and wherein $R^1$ and $R^2$ contain 3 to 5 carbon atoms, n is 1, and T is monovalent metal or

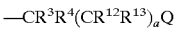

wherein a is 1 and $R^3$, $R^4$, $R^{12}$ and $R^{13}$ are hydrogen, and Q is

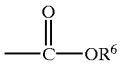

wherein $R_6$ is an alkyl group containing 1 to 4 carbon atoms; and (B) a sludge preventing and seal protecting amount of at least one aldehyde or epoxide or mixtures thereof.

2. The composition of claim 1 wherein $R^6$ is methyl.

3. A composition for reducing sludge and degradation of elastomer seals having a major amount of an oil of lubricating viscosity and a minor amount of (A) at least one thiocarbamate of the structure

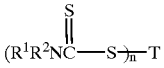

(I)

wherein $R^1$ and $R^2$ are independently alkyl, aryl, aralkyl or together form an alicyclic or heteroalicyclic ring in which the ring is completed through the nitrogen, wherein $R^1$ and $R^2$ contain 3 to 5 carbon atoms; n is 2; and T is a divalent metal or hydrocarbylene; and (B) a sludge preventing and seal protecting amount of at least one aldehyde or epoxide or mixtures thereof.

4. The composition of claim 3 wherein T is a divalent metal comprising the alkaline earth metals, cadmium, tin, molybdenum, iron, copper, nickel, cobalt, chromium, and lead.

5. The composition of claim 4 wherein the divalent metal is magnesium, zinc, or molybdenum.

6. A composition for reducing sludge and degradation of elastomer seals having a major amount of an oil of lubricating viscosity and a minor amount of (A) at least one thiocarbamate of the structure

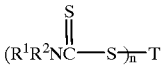

(I)

wherein $R^1$ and $R^2$ are independently alkyl of 1 to about 7 carbon atoms, aryl, aralkyl or together form an alicyclic or heteroalicyclic ring in which the ring is completed through the nitrogen, n is 1 or 2 and wherein when n is 1, T is monovalent metal or

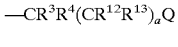

wherein a is 0 or 1, $R^3$, $R^4$, $R^{12}$ and $R^{13}$ are independently hydrogen, alkyl or aryl and Q is

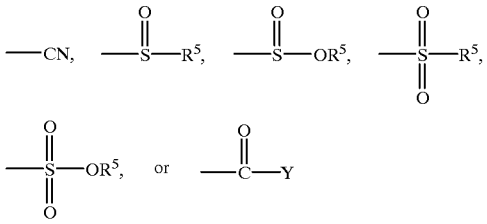

wherein $R^5$ is hydrogen, alkyl, or aralkyl, Y is hydrogen —OH, $R^6$, —$OR^6$, —$OR^7$—OH, or —$NR^8R^9$ where $R^6$ is alkyl, aryl or aralkyl, $R^7$ is alkylene of 1 to about 7 carbon atoms and $R^8$ and $R^9$ are independently hydrogen, alkyl, cycloaliphatic, heteroalicyclic or together form an alicyclic or heteroalicyclic radical in which the ring is completed through the nitrogen with the proviso that when a is 0, Y is —$OR^6$; and wherein when n is 2, T is a divalent metal or hydrocarbylene containing 1 to 4 carbon atoms; and (B) a sludge preventing and seal protecting amount of at least one aldehyde or epoxide or mixtures thereof.

7. The composition of claim 6 wherein the hydrocarbylene is methylene.

8. A composition for reducing sludge and degradation of elastomer seals having a major amount of an oil of lubricating viscosity and a minor amount of (A) at least one thiocarbamate of the structure (I)

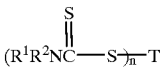

wherein $R^1$ and $R^2$ are independently alkyl of 1 to about 7 carbon atoms, aryl, aralkyl or together form an alicyclic or heteroalicyclic ring in which the ring is completed through the nitrogen, n is 1 or 2 and wherein when n is 1, T is monovalent metal or $$—CR^3R^4(CR^{12}R^{13})_aQ$$

wherein a is 0 or 1, $R^3$, $R^4$, $R^{12}$ and $R^{13}$ are independently hydrogen, alkyl or aryl and Q is

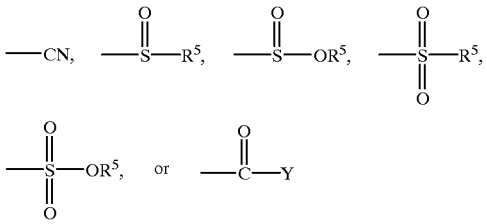

wherein $R^5$ is hydrogen, alkyl, or aralkyl, Y is hydrogen —OH, $R^6$, —$OR^6$, —$OR^7$—OH, or —$NR^8R^9$ where $R^6$ is alkyl, aryl or aralkyl, $R^7$ is alkylene of 1 to about 7 carbon atoms and $R^8$ and $R^9$ are independently hydrogen, alkyl, cycloaliphatic, heteroalicyclic or together form an alicyclic or heteroalicyclic radical in which the ring is completed through the nitrogen with the proviso that when a is 0, Y is —$OR^6$; and wherein when n is 2, T is a divalent metal or hydrocarbylene; and (B) a sludge preventing and seal protecting amount of at least one aldehyde or epoxide or mixtures thereof, wherein the aldehyde is an aromatic aldehyde.

9. The composition of claim 8 wherein the aromatic aldehyde is a substituted phenyl aldehyde.

10. The composition of claim 8 wherein the aromatic aldehyde is a vanillin, o-vanillin, salicylaldehyde or an alkyl substituted salicylaldehyde.

11. The composition of claim 10 wherein the aldehyde is vanillin or o-vanillin.

12. The composition of claim 8 wherein the aldehyde is a salicyladehyde or 3,5-di-t-butylsalicylaldehyde.

13. A composition for reducing sludge and degradation of elastomer seals having a major amount of an oil of lubricating viscosity and a minor amount of (A) at least one thiocarbamate of the structure (I)

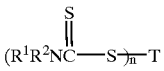

wherein $R^1$ and $R^2$ are independently alkyl of 1 to about 7 carbon atoms, aryl, aralkyl or together form an alicyclic or heteroalicyclic ring in which the ring is completed through the nitrogen, n is 1 or 2 and wherein when n is 1, T is monovalent metal or $$—CR^3R^4(CR^{12}R^{13})_aQ$$

wherein a is 0 or 1, $R^3$, $R^4$, $R^{12}$ and $R^{13}$ are independently hydrogen, alkyl or aryl and Q is

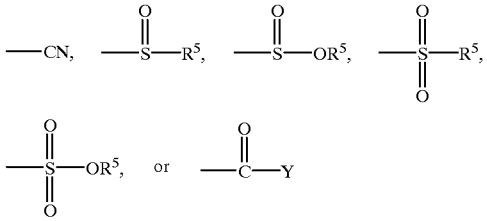

wherein $R^5$ is hydrogen, alkyl, or aralkyl, Y is hydrogen —OH, $R^6$, —$OR^6$, —$OR^7$—OH, or —$NR^8R^9$ where $R^6$ is alkyl, aryl or aralkyl, $R^7$ is alkylene of 1 to about 7 carbon atoms and $R^8$ and $R^9$ are independently hydrogen, alkyl, cycloaliphatic, heteroalicyclic or together form an alicyclic or heteroalicyclic radical in which the ring is completed through the nitrogen with the proviso that when a is 0, Y is —$OR^6$; and wherein when n is 2, T is a divalent metal or hydrocarbylene; and (B) a sludge preventing and seal protecting amount of at least one aldehyde or epoxide or mixtures thereof; wherein the epoxide has at least one oxirane ring and wherein at least one internal oxirane ring is present.

14. A composition for reducing sludge and degradation of elastomer seals having a major amount of an oil of lubricating viscosity and a minor amount of (A) at least one thiocarbamate of the structure (I)

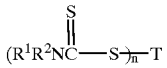

wherein $R^1$ and $R^2$ are independently alkyl of 1 to about 7 carbon atoms, aryl, aralkyl or together form an alicyclic or heteroalicyclic ring in which the ring is completed through the nitrogen, n is 1 or 2 and wherein when n is 1, T is monovalent metal or $$—CR^3R^4(CR^{12}R^{13})_aQ$$

wherein a is 0 or 1, $R^3$, $R^4$, $R^{12}$ and $R^{13}$ are independently hydrogen, alkyl or aryl and Q is

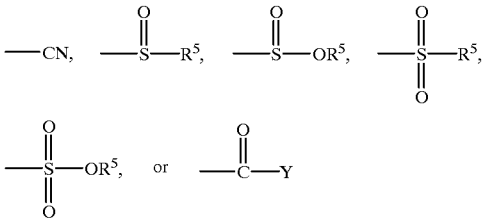

wherein $R^5$ is hydrogen, alkyl, or aralkyl, Y is hydrogen —OH, $R^6$, —$OR^6$, —$OR^7$—OH, or —$NR^8R^9$ where $R^6$ is alkyl, aryl or aralkyl, $R^7$ is alkylene of 1 to about 7 carbon atoms and $R^8$ and $R^9$ are independently hydrogen, alkyl, cycloaliphatic, heteroalicyclic or together form an alicyclic or heteroalicyclic radical in which the ring is completed through the nitrogen with the proviso that when a is 0, Y is —$OR^6$; and wherein when n is 2, T is a divalent metal or hydrocarbylene; and (B) a sludge preventing and seal protecting amount of at least one aldehyde or epoxide or mixtures thereof, wherein the epoxide has at least one oxirane ring, the oxirane ring is terminal, and the epoxide is of the formula

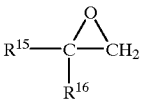

wherein $R^{15}$ is an alkyl group containing from 1 to 40 carbon atoms and $R^{16}$ is hydrogen.

15. A composition for reducing sludge and degradation of elastomer seals having a major amount of an oil of lubricating viscosity and a minor amount of (A) at least one thiocarbamate of the structure (I)

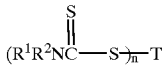

wherein $R^1$ and $R^2$ are independently alkyl of 1 to about 7 carbon atoms, aryl, aralkyl or together form an alicyclic or heteroalicyclic ring in which the ring is completed through the nitrogen, n is 1 or 2 and wherein when n is 1, T is monovalent metal or $$—CR^3R^4(CR^{12}R^{13})_aQ$$

wherein a is 0 or 1, $R^3$, $R^4$, $R^{12}$ and $R^{13}$ are independently hydrogen, alkyl or aryl and Q is

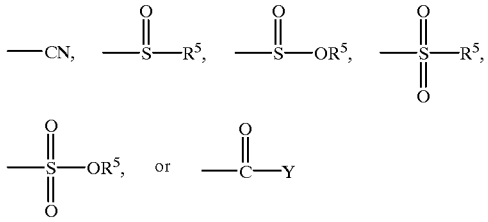

wherein $R^5$ is hydrogen, alkyl, or aralkyl, Y is hydrogen —OH, $R^6$, —$OR^6$, —$OR^7$—OH, or —$NR^8R^9$ where $R^6$ is alkyl, aryl or aralkyl, $R^7$ is alkylene of 1 to about 7 carbon atoms and $R^8$ and $R^9$ are independently hydrogen, alkyl, cycloaliphatic, heteroalicyclic or together form an alicyclic or heteroalicyclic radical in which the ring is completed through the nitrogen with the proviso that when a is 0, Y is —$OR^6$; and wherein when n is 2, T is a divalent metal or hydrocarbylene; and (B) a sludge preventing and seal protecting amount of at least one aldehyde or epoxide or mixtures thereof, wherein the epoxide has at least one oxirane ring, the oxirane ring is terminal, and the epoxide is of the formula

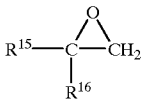

wherein $R^{15}$ is an alkyl group containing from 1 to 40 carbon atoms and $R^{16}$ is methyl.

16. The composition of claim 14 wherein $R^{15}$ is $R^{18}OCH_2$— wherein $R^{18}$ is an alkyl group containing from 1 to 18 carbon atoms.

17. The composition of claim 14 wherein $R^{15}$ is

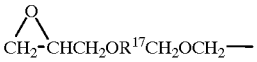

wherein $R^{17}$ contains from 1 to 12 carbon atoms.

18. The composition of claim 13 wherein the epoxide is of the formula

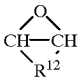

wherein $R^{12}$ is an alkylene group containing 3 or 4 carbon atoms.

19. The composition of claim 13 wherein the epoxide is of the formula

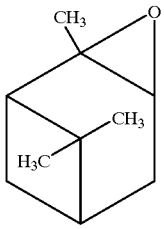
,
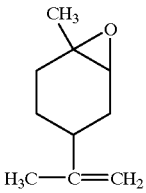
or
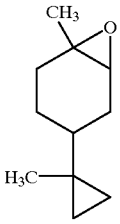
.
20. The composition of claim 13 wherein the epoxide is of the formula
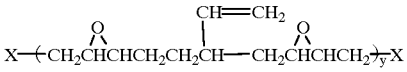
wherein X is independently —H or —OH and y is an integer of from 2 to 6.
21. The composition of claim 13 wherein the epoxide is a vegetable oil epoxide.
22. The composition of claim 13 wherein the epoxide is an alkyl ester of a vegetable oil epoxide wherein the ester group contains from 1 to 8 carbon atoms.
* * * * *